US008299384B2

(12) United States Patent
Yeon

(10) Patent No.: US 8,299,384 B2
(45) Date of Patent: Oct. 30, 2012

(54) GAS INSULATION CIRCUIT BREAKER WITH STRUCTURE FOR DECREASING FRICTION

(75) Inventor: Man Seung Yeon, Gyeonggi-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 189 days.

(21) Appl. No.: 12/855,044

(22) Filed: Aug. 12, 2010

(65) Prior Publication Data

US 2011/0036813 A1 Feb. 17, 2011

(30) Foreign Application Priority Data

Aug. 17, 2009 (KR) ..... 10-2009-0075883

(51) Int. Cl.
*H01H 33/42* (2006.01)

(52) U.S. Cl. ..... 218/59; 218/81

(58) Field of Classification Search ..... 218/59–62, 218/81

See application file for complete search history.

(56) References Cited

U.S. PATENT DOCUMENTS

2010/0163527 A1 7/2010 Yoon

*Primary Examiner* — Truc Nguyen

(74) *Attorney, Agent, or Firm* — Greenblum & Bernstein, P.L.C.

(57) ABSTRACT

Disclosed is a gas insulation circuit breaker with a structure for decreasing friction. The gas insulation circuit breaker comprises: a movable side supporting plate; a cylinder mounted so as to perform a reciprocating movement in a state that an outer surface thereof comes in contact with an inner surface of the movable side supporting plate; a contact spring for conduction disposed between the movable side supporting plate and the cylinder; and a movable arc contactor and a fixed arc contactor installed at the movable side supporting plate and the cylinder, respectively, and contacting and separated from each other by movement of the cylinder, wherein an end of the cylinder is tapered, and the outer surface of the cylinder comes in contact with the contact spring for conduction after a predetermined time lapses in a state that the cylinder has started to perform a closing operation during a circuit breaking operation.

8 Claims, 6 Drawing Sheets

GAS INSULATION CIRCUIT BREAKER WITH STRUCTURE FOR DECREASING FRICTION

CROSS-REFERENCE TO A RELATED APPLICATION

Pursuant to 35 U.S.C. §119(a), this application claims the benefit of earlier filing date and right of priority to Korean Application 10-2009-0075883, filed on Aug. 17, 2009, the content of which is incorporated by reference herein in its entirety.

BACKGROUND OF THE INVENTION

1. Field of the Invention

The present invention relates to a gas insulation circuit breaker with a structure for reducing friction, and particularly, to a gas insulation circuit breaker capable of extinguishing an arc by blowing arc-extinguishing gas to a space between a fixed arc contactor and a movable arc contactor at the time of a circuit breaking operation.

2. Background of the Invention

FIG. 1 is a gas insulation circuit breaker in accordance with the conventional art, which shows a structure of a circuit breaking portion, and FIG. 2 is a view showing an operational state of the circuit breaking portion of FIG. 1.

As shown, the circuit breaking portion of the conventional gas insulation circuit breaker consists of a fixed side and a movable side.

The fixed side consists of a first fixed contactor 1 and a fixed arc contactor 2.

The movable side consists of a second fixed contactor 3, a movable contactor 4 movably installed in the second fixed contactor 3, a fixed piston 5 installed in the movable contactor 4 and forming a compression chamber 6, a movable arc contactor 7 connected to or separated from the fixed arc contactor 2 by being moved together with the movable contactor 4, a nozzle 8 fixed to the movable contactor 4, and a connection rod 9 configured to connect a rod 10 of the movable contactor 4 to a manipulation unit (not shown) of a circuit breaker.

In a case that the circuit breaker is in a normal conductive state, as shown in FIG. 1, the movable arc contactor 7 is connected to the fixed arc contactor 2, thereby maintaining a closed circuit.

In this state, if the circuit breaker is tripped, force is transmitted to the connection rod 9 connected to the manipulation unit in a right direction (opening direction), and thus a trip operation of a high speed is started. And, the movable contactor 4 connected to the connection rod 9 by the rod 10, and the movable arc contactor 7 are moved together toward a moving direction of the connection rod 9.

Here, a capacity of the compression chamber 6 formed by the movable contactor 4 and the fixed piston 5 is drastically decreased as the movable contactor 4 is moved. Upon separation of the movable arc contactor 7 from the fixed arc contactor 2 due to movement of the movable contactor 4, an arc occurs between the movable arc contactor 7 and the fixed arc contactor 2. In the event of the arc occurrence, compressed gas inside the compression chamber 6 is injected through a nozzle 8 toward an arc, thereby extinguishing an arc and breaking (cutting off) a current.

The circuit breaker repeatedly performs a closing operation and a trip operation so as to maintain and break a conducted current, respectively. Here, the circuit breaker has to be operated with a normal speed. However, the circuit breaker may not maintain a normal speed due to load increment between inner contacts by repeated operations, and due to particle generations by friction.

FIG. 3 shows another example of the circuit breaker. Referring to FIG. 3, reference numeral 11 denotes a fixed side supporting plate, 12 denotes a fixed arc contactor, 13 denotes a gas injection nozzle, 14 denotes a movable arc contactor, 15 denotes a gas injection supplementary nozzle, 16 denotes a movable side supporting plate, 17 and 19 denote wear rings, 18 denotes a contact spring for conduction, 20 denotes a puffer cylinder, 21 denotes a movable arc contactor, and 22 denotes a cylinder rod.

Referring to FIG. 3, the wear rings 17, 19 and the contact spring for conduction 18 are fixed to the movable side supporting plate 16, and come in contact with the puffer cylinder 20 vertically reciprocating in the movable side supporting plate 16. As a result, as the gas insulation circuit breaker is repeatedly operated, marks or particles may occur on the surface of the puffer cylinder 20 due to friction between the puffer cylinder 20 and the contact spring for conduction 18. This may badly influence on a normal speed of the circuit breaker.

SUMMARY OF THE INVENTION

Therefore, an object of the present invention is to provide a gas insulation circuit breaker capable of preventing the occurrence of particles by reducing friction which occurs during an operation.

To achieve these and other advantages and in accordance with the purpose of the present invention, as embodied and broadly described herein, there is provided a gas insulation circuit breaker, comprising: a movable side supporting plate; a cylinder mounted so as to perform a reciprocating movement in a state that an outer surface thereof comes in contact with an inner surface of the movable side supporting plate; a contact spring for conduction disposed between the movable side supporting plate and the cylinder; and a movable arc contactor and a fixed arc contactor installed at the movable side supporting plate and the cylinder, respectively, and contacting and separated from each other by movement of the cylinder, wherein a fore end of the cylinder is tapered, and the outer surface of the cylinder comes in contact with the contact spring for conduction after a predetermined time lapses in a state that the cylinder has started to perform a closing operation during a circuit breaking operation.

Preferably, the outer surface of the cylinder and the contact spring for conduction may come in contact with each other before or at the same time when the movable arc contactor and the fixed arc contactor come in contact with each other. Here, the outer surface of the cylinder and the contact spring for conduction may come in contact with each other after the movable arc contactor and the fixed arc contactor come in contact with each other.

Preferably, a spring fixing groove may be formed in the movable side supporting plate, and the contact spring for conduction may be inserted into the spring fixing groove.

In order to prevent the contact spring for conduction from being separated from the spring fixing groove, a width of an opening of the spring fixing groove may be narrower than that of the rest part. Furthermore, a spring fixing piece extending along the spring fixing groove in a state spacing from a bottom surface of the spring fixing groove may be formed in the spring fixing groove, thereby fixing a spring in the spring fixing piece.

Preferably, one pair of wear ring-fixing grooves may be formed in a state that the spring fixing groove is disposed therebetween, and a wear ring may be inserted into each of the wear ring-fixing grooves.

A width of an opening of the wear ring-fixing groove may be narrower than that of the rest part, and protrusions facing each other may be formed at the opening of the wear ring-fixing groove. And, coupling grooves engaged with the protrusions may be formed on side surfaces of the wear ring-fixing groove.

According to another aspect of the present invention, there is provided a gas insulation circuit breaker, comprising: a supporting portion having a fixed arc contactor and a contact spring for conduction; and a cylinder reciprocating in the supporting portion, and having a movable arc contactor contacting or separated from the fixed arc contactor, wherein the cylinder is configured to partially overlap a facing surface of the supporting portion, and the cylinder being reciprocated contacts or is separated from the contact spring for conduction.

In the present invention, since an outer surface of the cylinder performing a sliding motion comes in partial contact with the contact spring for conduction, abrasion due to friction and the occurrence of particles may be reduced.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Hereinafter, a preferred embodiment of a gas insulation circuit breaker according to the present invention will be explained in more detail with reference to the attached drawings.

Figure 1:
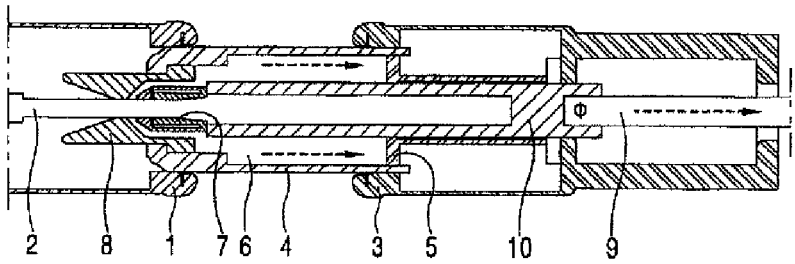
FIG. 1 PRIOR ART
FIGS. 1 and 2 are sectional views schematically showing an inner structure of a gas insulation circuit breaker in accordance with the conventional art.
Figure 2:
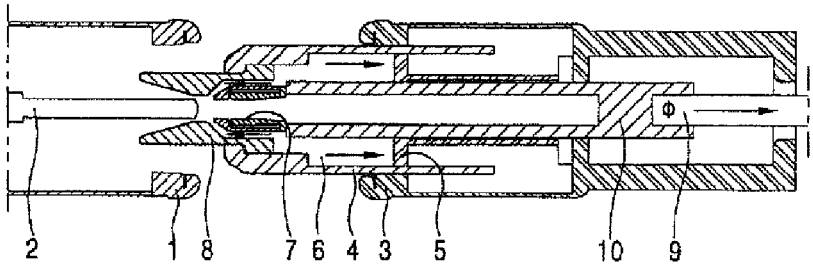
FIG. 2 PRIOR ART
Figure 3:
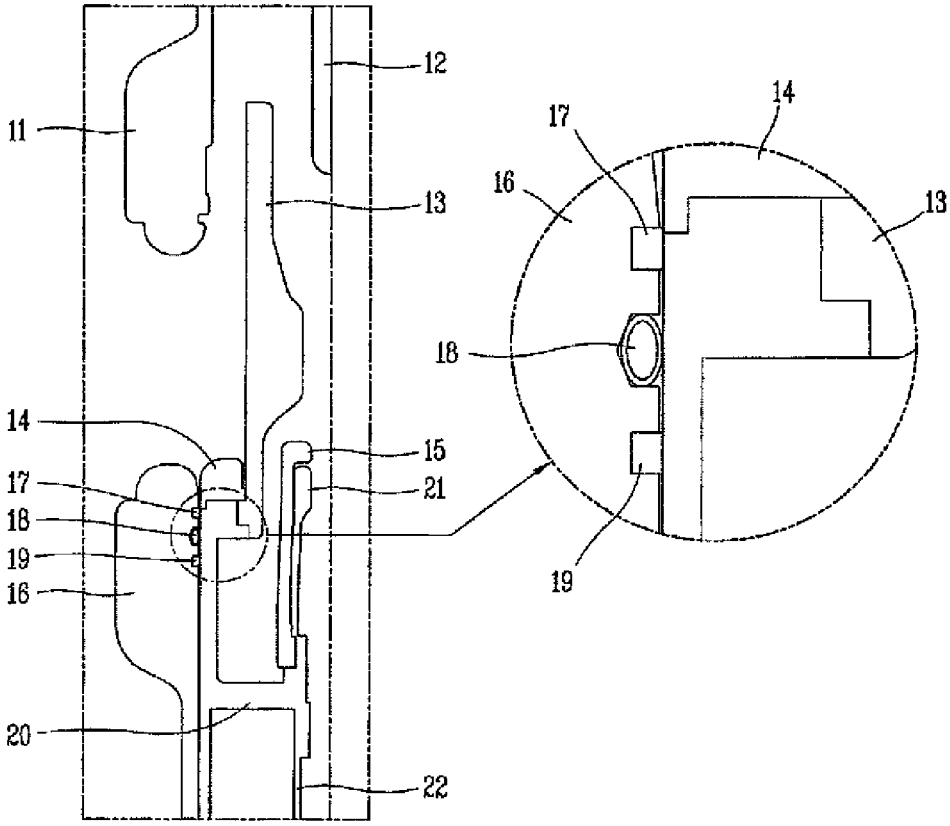
FIG. 3 PRIOR ART
FIG. 3 is a sectional view showing an inner structure of a gas insulation circuit breaker according to another example of the conventional art.
Figure 4:
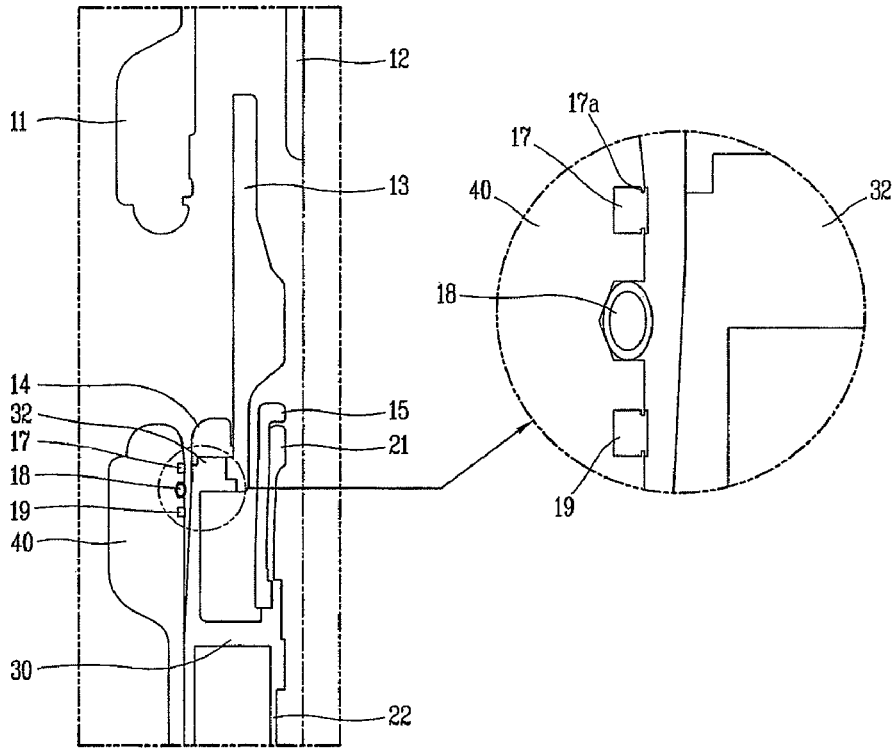
FIG. 4 is a view corresponding to FIG. 3, which shows a gas insulation circuit breaker according to one embodiment of the present invention.

FIG. 4 shows a gas insulation circuit breaker according to the present invention. The same parts of FIG. 4 as those of FIG. 3 will be provided with the same reference numerals, and their detailed descriptions will be omitted.

Referring to FIG. 4, reference numeral 40 denotes a movable side supporting plate, and wear rings 17, 19 and a contact spring for conduction 18 are installed in the movable side supporting plate 40 near the end of the movable side supporting plate 40. The wear rings 17, 19 and the contact spring for conduction 18 come in contact with a puffer cylinder 30 while being operated. A peripheral portion of the end of the puffer cylinder 30 is upwardly tapered in a direction spacing from the movable side supporting plate 40. In FIG. 4, the wear rings 17, 19 and the contact spring for conduction 18 are separated from the puffer cylinder 30. Accordingly, required is a means for allowing the wear rings 17, 19 and the contact spring for conduction 18 to maintain precise positions without being separated from the movable side supporting plate 40.

Figure 5:
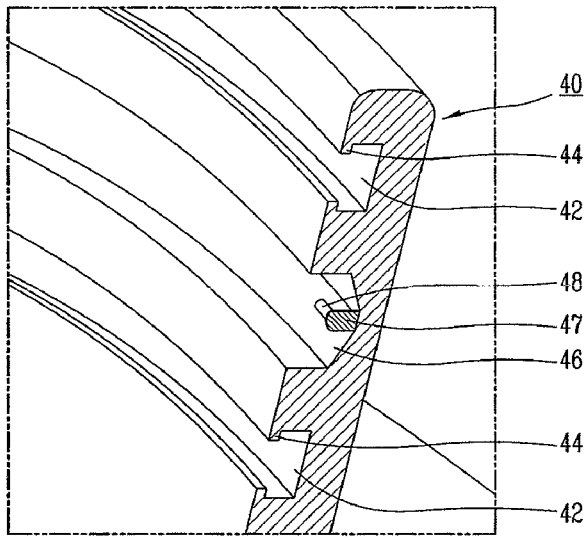
FIG. 5 is a perspective view showing an enlarged inner wall surface of a supporting portion in FIG. 4.

FIG. 5 illustrates an example of the fixing means, which shows fixing grooves for inserting the wear rings 17, 19 and the contact spring for conduction 18 thereinto. As shown in FIG. 5, one pair of wear ring-fixing grooves 42 and a spring fixing groove 46 are formed in the movable side supporting plate 40. The spring fixing groove 46 is formed between the wear ring-fixing grooves 42.

The wear ring-fixing grooves 42 have a rectangular sectional surface, and one pair of protrusions 44 protruding toward the center from both inner walls are formed at upper ends of the wear ring-fixing grooves 42. The protrusions 44 are engaged with coupling grooves 17*a* (refer to FIG. 4) formed on side surfaces of a wear ring mounted in the wear ring-fixing groove 42, thereby preventing separation of the wear ring 17 from the movable side supporting plate 40 due to friction with the puffer cylinder 30 during the operation.

Various types of fixing means rather than the aforementioned fixing means may be implemented. For instance, the wear ring-fixing groove may be implemented so as to have a sectional surface tapered toward an upward direction.

In the spring fixing groove 46, formed are a supporting portion protruding from a bottom surface of the spring fixing groove 46, and a fixing piece 48 extending from the supporting portion 47 along an extended direction of the spring fixing groove 46. As shown in FIG. 4, the fixing piece 48 allows the contact spring for conduction 18 to be fitted between a bottom surface and the fixing piece 48, thereby stably fixing the contact spring for conduction 18.

The fixing means for the contact spring for conduction 18 may be also modified in various manners. For instance, the spring fixing groove 46 may be configured so as to be tapered, and the contact spring for conduction 18 may be inserted into the spring fixing groove 46 so that a part thereof can be protruding to outside of the spring fixing groove 46.

Hereinafter, the preferred embodiment will be explained in more detail with reference to FIGS. 6 to 8.

Figure 6:
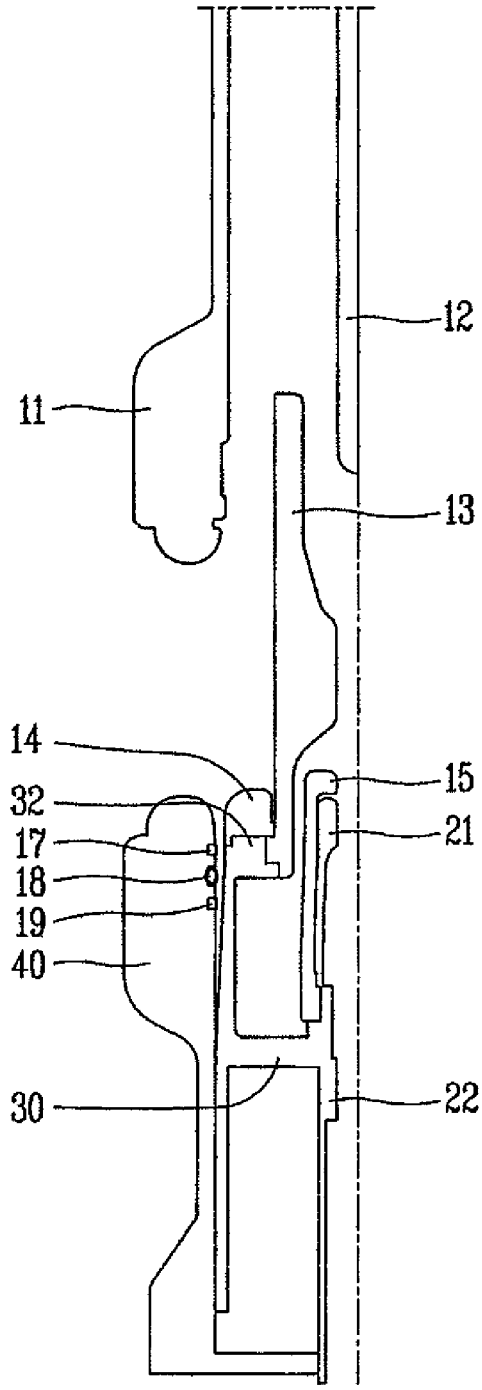
FIGS. 6 to 8 are sectional views showing operational processes of the preferred embodiment of FIG. 4.

FIG. 6 illustrates a state that the puffer cylinder 30 has been withdrawn, i.e., a tripped state. The state of FIG. 6 is the same as the state of FIG. 4. Accordingly, the wear rings 17, 19 and the contact spring for conduction 18 are in a separated state from the puffer cylinder 30.

Figure 7:
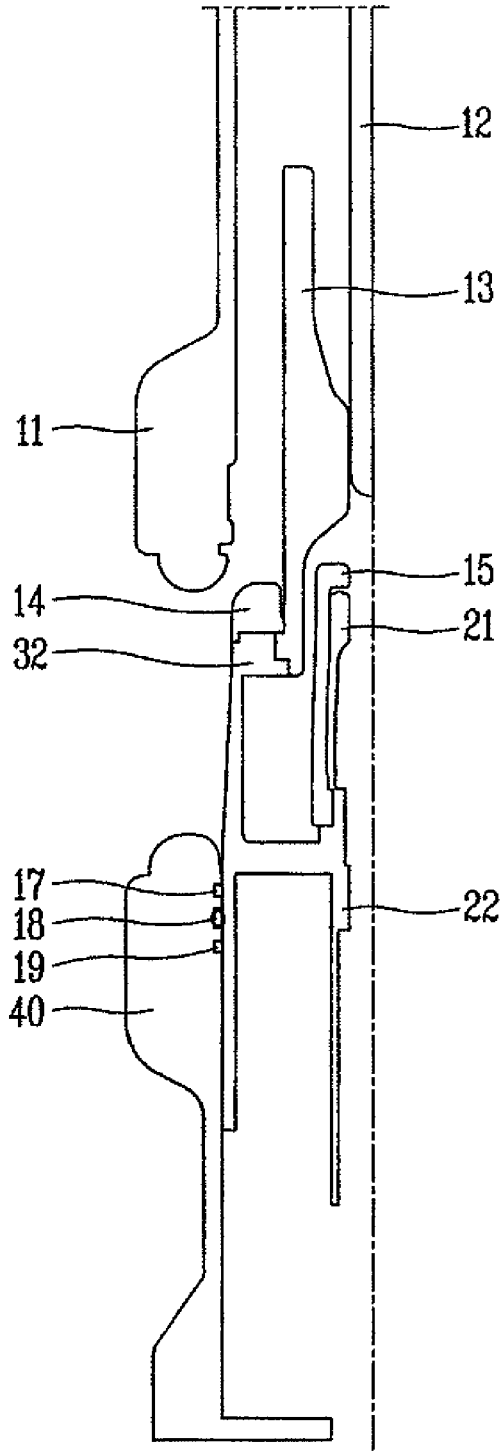

As shown in FIG. 7, the puffer cylinder 30 starts to slide upwardly for conduction, and starts to contact the wear rings 17, 19 and the contact spring for conduction 18 from the end of the tapered portion. The wear rings 17, 19 and the contact spring for conduction 18 contact the puffer cylinder 30 at the same time when the circuit breaker starts to conduct a current as the puffer cylinder 30 is upwardly moved. Here, the contact may be executed before or after the conduction.

Figure 8:
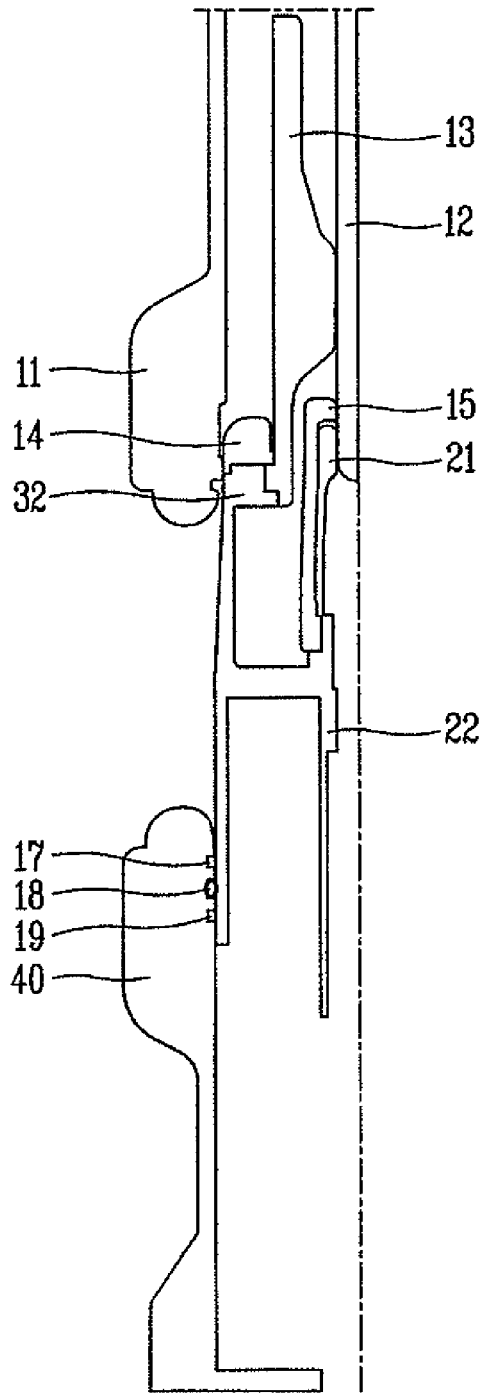

Once the puffer cylinder 30 has been completely upwardly moved, a state shown in FIG. 8 is implemented. And, the wear rings 17, 19 and the contact spring for conduction 18 maintain a contacted state with the puffer cylinder 30.

In the preferred embodiment, the wear rings 17, 19 and the contact spring for conduction 18 contact the puffer cylinder 30 only after a predetermined time lapses during a closing operation or a trip operation by the circuit breaker. Accordingly, when the circuit breaker performs a closing operation for current conduction and a trip operation for breaking a conducted current, operational loads may be reduced. Furthermore, a frictional area between the contact spring for conduction and the puffer cylinder may be reduced, thereby preventing the occurrence of particles.

In the preferred embodiment, the contact is performed after a predetermined time lapses in a state that the circuit breaker has started to perform a closing operation. However, it is also possible to perform the contact at an initial stage of the closing operation, and to perform separation after a predetermined time lapses. Alternatively, the separation may be performed at an intermediate stage of the closing operation.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A gas insulation circuit breaker, comprising:

a movable side supporting plate;

a cylinder mounted so as to perform a reciprocating movement in a state that an outer surface thereof comes in contact with an inner surface of the movable side supporting plate;

a contact spring for conduction disposed between the movable side supporting plate and the cylinder; and a movable arc contactor and a fixed arc contactor installed at the movable side supporting plate and the cylinder, respectively, and contacting and separated from each other by movement of the cylinder, wherein an end of the cylinder is tapered, and the outer surface of the cylinder comes in contact with the contact spring for conduction after a predetermined time lapses in a state that the cylinder has started to perform a closing operation during a circuit making operation.

2. The gas insulation circuit breaker of claim 1, wherein the outer surface of the cylinder and the contact spring for conduction come in contact with each other before or at the same time when the fixed arc contactor and the movable arc contactor come in contact with each other.

3. The gas insulation circuit breaker of claim 1, wherein a spring fixing groove is formed in the movable side supporting plate, and the contact spring for conduction is inserted into the spring fixing groove.

4. The gas insulation circuit breaker of claim 3, wherein a width of an opening of the spring fixing groove is narrower than that of the rest part.

5. The gas insulation circuit breaker of claim 3, wherein a spring fixing piece extending along the spring fixing groove in a state spacing from a bottom surface of the spring fixing groove is formed in the spring fixing groove.

6. The gas insulation circuit breaker of claim 3, wherein one pair of wear ring-fixing grooves are formed in a state that the spring fixing groove is disposed therebetween, and a wear ring is inserted into each of the wear ring-fixing grooves.

7. The gas insulation circuit breaker of claim 6, wherein a width of an opening of the wear ring-fixing groove is narrower than that of the rest part.

8. The gas insulation circuit breaker of claim 6, wherein protrusions facing each other are formed at the opening of the wear ring-fixing groove, and coupling grooves engaged with the protrusions are formed on side surfaces of the wear ring-fixing groove.

* * * * *